United States Patent [19]

Maü

[11] Patent Number: 4,652,478

[45] Date of Patent: Mar. 24, 1987

[54] FLOCK TRANSFER SHEET PATCH

[75] Inventor: Volker Maü, Wuppertal, Fed. Rep. of Germany

[73] Assignee: Franz Josef Rath, Plettenberg, Fed. Rep. of Germany

[21] Appl. No.: 823,956

[22] Filed: Jan. 29, 1986

[30] Foreign Application Priority Data

Jan. 30, 1985 [DE] Fed. Rep. of Germany ..... 3502990

[51] Int. Cl.[4] ..... B44C 3/02

[52] U.S. Cl. ..... 428/43; 428/90

[58] Field of Search ..... 428/43, 90

[56] References Cited

U.S. PATENT DOCUMENTS 3,379,604 4/1968 Weber et al. ..... 428/90

4,142,929 3/1979 Otomine et al. ..... 428/90

*Primary Examiner*—Marion C. McCamish

*Attorney, Agent, or Firm*—Antonelli, Terry & Wands

[57] ABSTRACT

A multiple-layer flock transfer sheet patch (15) exhibits a flock layer (2) coated on its mounting surface (3) with a strongly adhering hot sealing adhesive layer (4) and detachably mounted, on its visible face (5), on a rigidifying carrier panel (7) by way of a slightly adhering adhesive layer (6). In order to make it possible to apply with accurate fit especially intricate and/or multicolored designs in a convenient fashion and without damaging the flock coating (2), and to be able to provide large flock fiber lengths even with a multicolored pattern of the designs, the carrier panel (7) is provided on its outside (8) with a strongly adhering layer (9) of hot sealing adhesive. In order to broaden the possibilities for utilizing the patch (15), the latter consists of two or several previously punched, flat pieces (16, 17, 18) joined by way of predetermined separating webs (19).

8 Claims, 14 Drawing Figures

Figure 8:
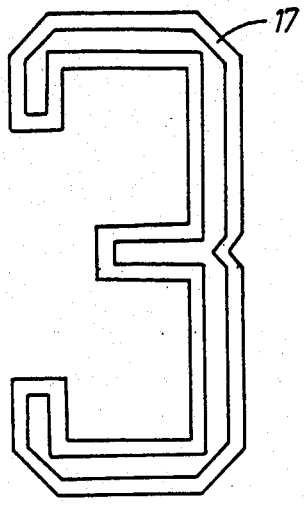

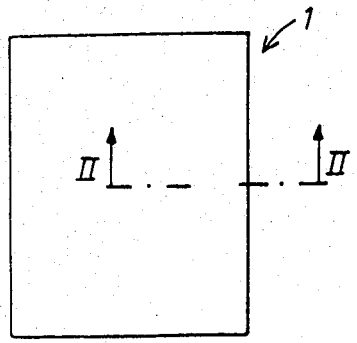
Fig. 1
Fig. 2
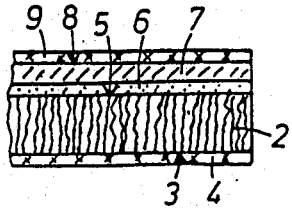
Fig. 3
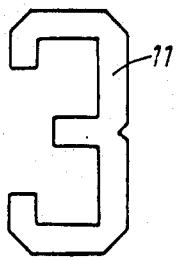
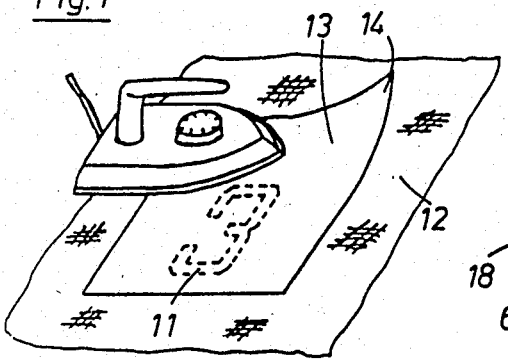
Fig. 4
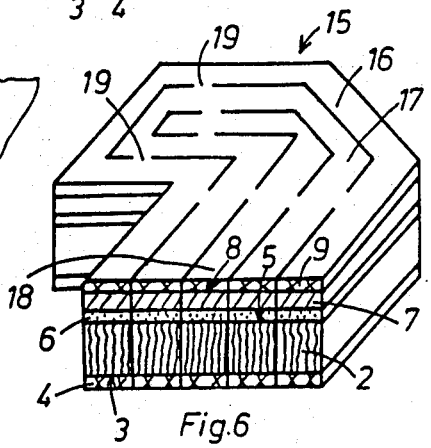
Fig. 6
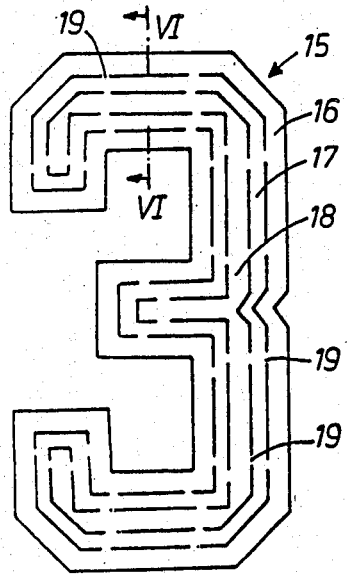
Fig. 5
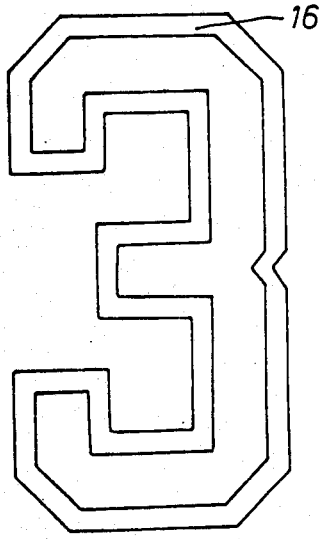
Fig. 7

FLOCK TRANSFER SHEET PATCH

The invention relates to a multiple, cut-to-size flock transfer sheet exhibiting a flock layer, the latter being coated on its mounting surface with a strongly adhering hot sealing adhesive layer and being detachably mounted, on its visible face, on a rigidifying carrier panel by way of a slightly adhering adhesive layer.

Flock transfer sheet patches customarily serve for the application of flat or linear designs to textile materials, for example flags, T-shirts, or the like. Cut-to-size flock transfer sheets are known wherein the flock layer, the congruent, slightly adhering adhesive layer, and the congruent, rigidifying carrier panel exhibit a rectangular basic outline. The strongly adhering hot sealing adhesive layer is, however, applied merely to a limited area in the shape of the design to be transferred. On account of the rigidifying carrier panel, it is made possible by means of the conventional patch to transfer even very intricate designs to textile material, but also to paper, smooth wood surfaces, or the like. Since, however, the actual, limited region of the design is covered by the rectangular carrier panel during the ironing-on step, an exact positioning of the patterns is impossible. A special problem here resides in providing accurate matching with already applied flock transfer designs, required, for example, for the combination of varicolored design sections.

It is furthermore known, in patches of the above-described structure, to imprint the flock layer in the zone of the design to be transferred to be of differing colors. Although thereby surface area sections of a design giving a varicolored pattern are joined in a matching composition, the exact positioning of the total design can still only be realized with difficulties. A predominant drawback, however, is that the color combination is determined solely by the manufacturer, rather than by the buyer or consumer himself. Furthermore, in case of a multicolored print, only those sheets can be used which exhibit very short flock fiber lengths since otherwise the colors would blur between the sectional areas. Consequently, the remaining, short fibers are extensively saturated by the hot sealing adhesive during the ironing-on step, and the tufty, textile character of the flock layer is lost.

Flock transfer sheet patches are furthermore conventional wherein the flock layer is provided on the mounting surface with a layer of hot sealing adhesive and on the visible side with an adhesive layer and a carrier panel, but with the aforementioned patch already exhibiting the shape of the design to be applied. Although accurate positioning of the designs or design sections is made possible in such cut-to-size articles, considerable difficulties are encountered in pulling off the rigidifying carrier panel after the patch has been ironed on. In order to find a suitable grip, a corner of the carrier panel must be lifted with a fingernail or a knife, and damage to the flock layer can easily occur during such a step.

Also, flock transfer sheet patches have been known consisting merely of a flock layer with a layer of hot sealing adhesive, the latter layer being covered by a protective film. In this case, the patch generally has directly the shape of the design to be transferred, provisions also having been made for the formation of designs with varicolored area sections. However, in these patches, the protective film must be pulled off the hot sealing adhesive layer even before the ironing-on step so that the design sections to be applied become very slack and unstable, and warping cannot be excluded. Thus, the accurately matching transfer especially of filigree designs is almost impossible for a final consumer who is not a professional.

The invention is based on the object of providing a flock transfer sheet patch of the above type wherein an accurately matching application, especially of intricate and/or multicolored designs, is possible in a convenient way and without damaging the flock layer, and wherein large flock fiber lengths can be provided even in case of a multicolored character of the designs.

This object has been attained according to the invention by providing the carrier panel on its outside with a strongly adhering hot sealing adhesive layer. With this structure, the cut-to-size piece can possess the configuration of the design to be transferred from the beginning, the carrier panel, even in case of an intricate structure, ensuring adequate rigidity for an exactly matching positioning. After accurate alignment, the patch is covered by a sheet of paper or a panel of a fabric of any desired form and is then ironed on so that both hot sealing adhesive layers are activated. The carrier panel can thereafter be easily pulled off with the aid of the additional sheet of paper. If a multicolored character of a design is desired, then a second patch can at this point be fitted with accurate matching against the first patch, the result being an especially clean transition without gaps, particularly in case of relatively large flock fiber lengths.

In accordance with the invention, the patch can be fashioned as a rectangular sheet provided on both sides up to the rim uniformly with the hot sealing adhesive layers. Such a rectangular sheet can be utilized in its entirety for decorative purposes, for example for the flat covering of walls or billiard tables. Since the carrier panel is still joined to the sheet even during the ironing-on step, and thus ensures dimensional stability for the flock layer, the assembly of several rectangular flock layers is completely uncritical in spite of the very long junction lines. However, the user can also optionally cut out any desired patterns from the rectangular sheet proper and then transfer these to a T-shirt or the like.

According to this invention, the cutout can take the shape of flat or linear designs, such as, for example, circles, ellipses, letters or numerals. Predetermination of the shape of the cutout by the manufacturer is advantageous, especially in case of more complex designs. Since the finished designs possess adequate inherent stability because of the rigidifying carrier panel, they can be supplied as a finished article in their final configuration. Consequently, the user is saved from having to detach the patch from stabilizing packaging carrier films or the like, and can proceed directly to applying the patch.

In accordance with the invention, the length of the flock fibers can be 0.3–1.5 mm, preferably about 1 mm. This fiber length can be realized, in particular, also with multicolored designs composed of several partial areas so that also in this instance the flock layer shows a soft, fluffy consistency.

In accordance with an especially important further development of the invention, the cutting can consist of two or several previously punched surface sections joined together by way of predetermined separating webs. In this embodiment, the user is offered a number of possibilities for variation. First of all, he can transfer the surface sections, connected by the predetermined breaking webs, as a whole to a textile base fabric or the like, where after the ironing-on step no transition lines whatever can be perceived optically. Moreover, however, there is also the possibility of separating the various flat pieces from one another and utilize them individually. Finally, of special advantage is the combination with a cutout having the same shape but a differing color since in this way varicolored surface sections can be combined with one another.

According to the invention, the surface pieces of a design cutout can consist of one or several design frames and a design core. Apart from the very advantageous optical effect, this embodiment makes it possible to combine varicolored design cutouts of the same configuration in an especially simple way inasmuch as a direct mutual alignment of the individual flat pieces is provided on account of the construction as design frames and a design core.

In accordance with a further embodiment of the invention, it is possible to initially punch a design cutout or a rectangular sheet into area sections of building-block type, hanging together respectively via predetermined separating webs. The invention here can provide that all area sections of building-block type exhibit identical shape and size. Due to the fashioning of the individual flat pieces in the manner of building blocks, the user is afforded a plurality of design possibilities with regard to color structure and shape of the total designs.

Figure 9:
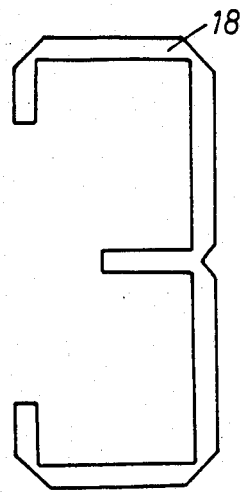
Figure 10:
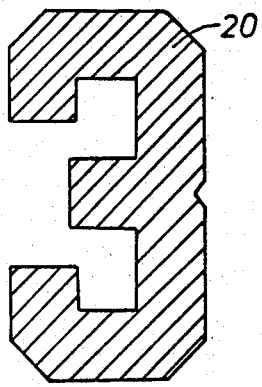
Figure 11:
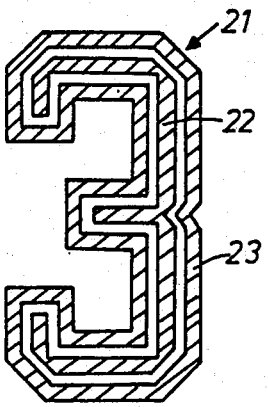
Figure 12:
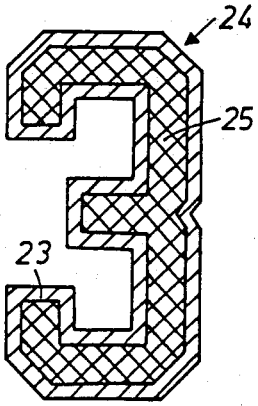
Figure 13:
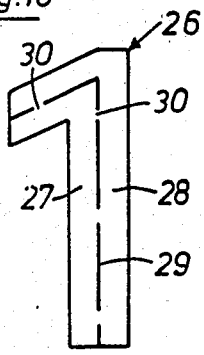
Figure 14:
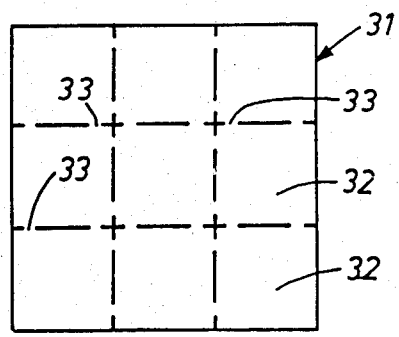

The invention will be described in greater detail below with reference to the drawing wherein:

FIG. 1 shows a first embodiment of a flock transfer sheet cutout in the shape of a rectangular panel, FIG. 2 shows the cutout along a section II—II in FIG. 1, FIG. 3 shows a linear design cut from the patch of FIG. 1, FIG. 4 shows the application of the linear design of FIG. 3 to a textile substrate, FIG. 5 shows a second embodiment of a flock transfer sheet cutout in the shape of several, previously punched flat pieces joined by predetermined breaking webs, FIG. 6 shows the cutout according to a section VI—VI in FIG. 5 in a perspective view, FIG. 7 shows a first area section of the cutout of FIG. 5, FIG. 8 shows a second area section of the cutout of FIG. 5, FIG. 9 shows a third area section of the cutout of FIG. 5, FIG. 10 shows the transferred patch according to FIG. 5 after the carrier panel has been pulled off, FIG. 11 shows the transferred, nestled first and third area sections of the cutout of FIG. 5, FIG. 12 shows area sections according to FIGS. 7–9 combined, but from differently colored cutouts of FIG. 5, in transferred form, FIG. 13 shows a third embodiment of a flock transfer sheet cutout, and FIG. 14 shows a fourth embodiment of a flock transfer sheet cutout.

FIG. 1 shows a first embodiment of a flock transfer sheet patch 1 in the form of a rectangular panel. In correspondence with FIG. 2, the patch has a flock layer 2 provided on its mounting surface 3 with a strongly adhering hot sealing adhesive layer 4. On its visible side 5, the flock layer 2 is bonded to a rigidifying carrier panel 7 by way of a weakly adhering layer 6 of adhesive; the carrier panel can consist of paper, for example. The carrier panel 7 is, in turn, provided on its outside 8 with another, strongly adhering hot sealing adhesive layer 9. The two hot sealing adhesive layers 4, 9 extend on both sides 3, 8 of the cutout 1 up to the outer margin 10.

An desired illustrations, for example a linear image 11 (see FIG. 3) can be cut out from the patch 1 by the user, adequate stiffness of the picture 11 being ensured by the carrier panel 7. FIG. 4 illustrates the transfer of such a picture 11 to a textile substrate 12. For this purpose, the picture 11 is accurately positioned at the desired location, covered with an auxiliary sheet 13 of paper or the like, and ironed on. The layer 4 of hot sealing adhesive at the bottom bonds during this step to the substrate 12, the layer 9 of hot sealing adhesive at the top bonds to the sheet 13. The sheet 13 can then be readily lifted at one corner 14 and pulled off together with the carrier panel 7, a detachment occurring in the zone of the adhesive layer 6.

The patch 1, inasmuch as it is provided with the hot sealing adhesive layers 4, 9 up to the rim 10, can, of course, also be placed as a whole on a substrate of textile material, paper, smooth wood, or the like.

A special diversity of applications is offered by a cutout 15 in the shape of a flat or linear design consisting of several previously punched, flat pieces 16, 17, 18, joined together by way of predetermined separating webs 19. In accordance with FIG. 6, the sequence of layers in this case is completely identical to the structure of FIG. 2. The cutout 15 can, first of all, be transferred as a whole without separating the webs 19, producing, after pulling off the carrier panel 7, a two-dimensional image 20 without visible transition lines, as illustrated in FIG. 10.

It is, however, also possible, by severing the webs 19, to utilize the flat pieces 16, 17, 18 as shown in FIGS. 7–9 individually or in combination with one another. In combined usage, the flat pieces 16, 17, 18 can be aligned with regard to one another especially easily, because the flat pieces 16 and 17 have a frame shape and the flat piece 18 is designed as a design core.

FIG. 11 here illustrates a first example of a transferred image 21 after pulling off the carrier panel 7, with a core 22 and an external frame 23, created from flat pieces 18 and 16. FIG. 12 shows a second embodiment of a transferred image 24 again exhibiting a frame 23. The closed core 25 is offset with respect to the outer frame 23 by a different coloring, but the core is made up of flat pieces corresponding geometrically to the flat pieces 17, 18. This example shows clearly that a plurality of different combination possibilities is obtained with two cutouts 15 according to FIG. 5 having differing colorations of the flock layers 2.

FIG. 13 shows a further embodiment for a cutting 26 made up of two previously punched flat pieces 27, 28, the punching line 29 being fashioned as a central separating line extending through to the rims. Also in this case, the area sections 27, 28 are joined by predetermined separating webs 30, opening up similar usage possibilities as in the embodiment of FIG. 5.

FIG. 14 illustrates another embodiment of a cutout 31 made up of previously punched, flat pieces 32 of identical shape and size of building-block type, again connected with one another by means of predetermined separating webs 33. The square-shaped cutout 31 can be transferred either as a whole or as a combination of several partial sections 32, for example in the shape of a cross. However, an especially broad array of designs results with the use of differently colored cutouts 31 which can be combined as a whole or as partial areas. Consequently, the cutout 31 is especially suitable for creating relatively large surfaces having a mosaic-like design.

I claim:

1. Multiple-layer flock transfer sheet patch exhibiting a flock layer which is coated on its mounting surface with a strongly adhering hot sealing adhesive layer and is detachably mounted, on its visible face, on a rigidifying carrier panel by way of a slightly adhering adhesive layer, characterized in that the carrier panel (7) is provided on its outside (8) with a strongly adhering hot sealing adhesive layer (9).

2. Patch according to claim 1, characterized in that it (1) is fashioned as a rectangular sheet provided on both sides (3, 8) up to the rim uniformly with the hot sealing adhesive layers (4, 9).

3. Patch according to claim 1, characterized in that it (15) has the shape of two-dimensional or linear designs, such as, for example, circles, ellipses, letters or numerals.

4. Patch according to one of claims 1–3, characterized in that the flock fiber length is 0.3–1.5 millimeters, preferably about 1 millimeter.

5. Patch according to one of claims 1–3, characterized in that the patch (15; 26) consists of two or several, previously punched flat pieces (16, 17, 18; 27, 28) connected with one another via predetermined separating webs (19; 30).

6. Patch according to claim 5, characterized in that the flat pieces (16, 17, 18) of a design patch (15) are made up of one or several design frames and a design core.

7. Patch according to claim 5, characterized in that a design patch (31) or rectangular panel has previously been punched to form flat pieces (32) in the manner of building blocks, respectively hanging together by way of predetermined separating webs (33).

8. Patch according to claim 7, characterized in that all flat pieces (32) of building-block type exhibit identical shape and size.

* * * * *